US005277212A

United States Patent [19]

Aronov

[11] Patent Number: 5,277,212

[45] **Date of Patent: * Jan. 11, 1994**

[54] DEVICE FOR PROTECTING AN UMBRELLA AGAINST INVERSION

[76] Inventor: Victor Aronov, 8620 Waukegan Rd., Morton Grove, Ill. 60053

[ * ] Notice: The portion of the term of this patent subsequent to Jul. 21, 2009 has been disclaimed.

[21] Appl. No.: 905,017

[22] Filed: Jun. 26, 1992

Related U.S. Application Data

[63] Continuation-in-part of Ser. No. 668,073, Mar. 12, 1991, Pat. No. 5,131,422.

[51] Int. Cl.[5] ..... A45B 25/02

[52] U.S. Cl. ..... 135/27; 135/33.5; 135/37

[58] Field of Search ..... 135/27, 33.5, 37

[56] References Cited

U.S. PATENT DOCUMENTS

| | | | |
|---|---|---|---|
| 122,453 | 1/1872 | Gossip . | |
| 161,962 | 4/1875 | Horton . | |
| 360,294 | 3/1887 | Haitz . | |
| 438,983 | 10/1890 | Bergensen . | |
| 539,752 | 5/1895 | Barnett . | |
| 540,098 | 5/1895 | Grove et al. . | |
| 597,717 | 1/1898 | Illoway . | |
| 773,499 | 10/1904 | Hirsch et al. . | |
| 850,341 | 4/1907 | Callahan . | |
| 1,378,354 | 5/1921 | Johnson . | |
| 2,114,598 | 4/1938 | Grissel . | |
| 2,465,140 | 3/1949 | Vila . | |
| 3,032,047 | 5/1962 | Wendorf . | |
| 3,042,055 | 7/1962 | Todxorovic . | |
| 4,300,582 | 11/1981 | Desarno . | |
| 4,407,317 | 10/1983 | Crandall . | |
| 5,131,422 | 7/1992 | Aronov | 135/27 |

FOREIGN PATENT DOCUMENTS

| | | |
|---|---|---|
| 667280 | 11/1938 | Fed. Rep. of Germany . |

*Primary Examiner*—Carl D. Friedman
*Assistant Examiner*—Lan M. Mai
*Attorney, Agent, or Firm*—Willian Brinks Hofer Gilson & Lione

[57] ABSTRACT

An umbrella includes a substantially inextensible cord which is mounted by couplers to the free ends of the ribs of the umbrella such that the cord forms a closed loop disposed radially inwardly of the ribs of the umbrella. The cord braces the umbrella against inversion, and the couplers can be designed to allow the cord to be retrofitted to an existing umbrella.

10 Claims, 4 Drawing Sheets

FIG. 1
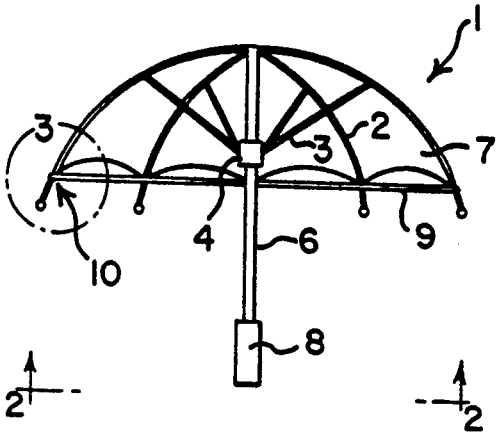
FIG. 2
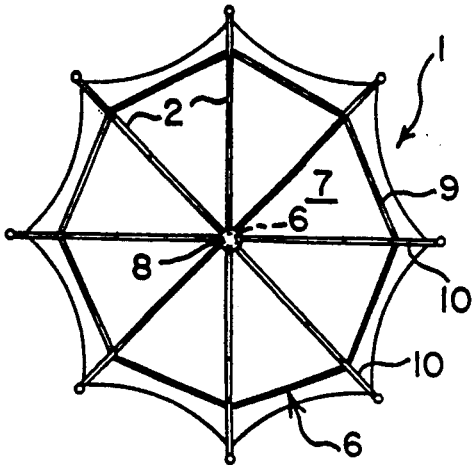
FIG. 3
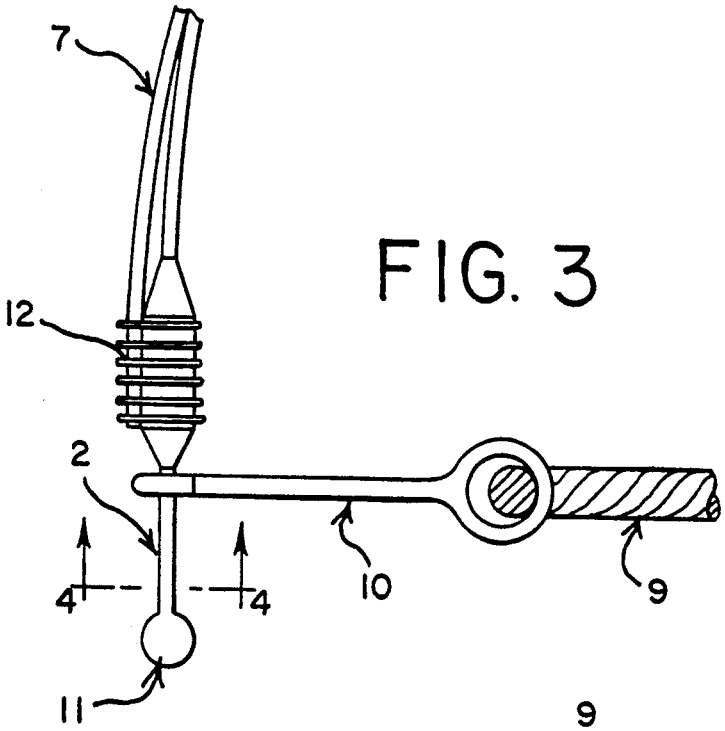
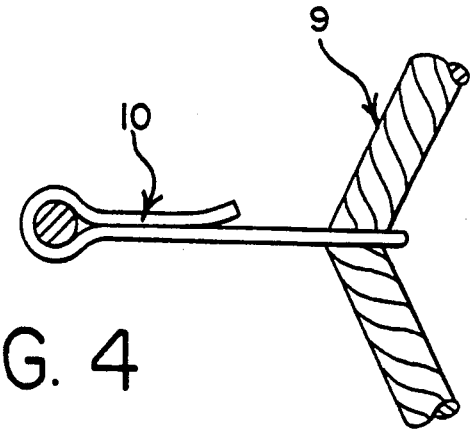
FIG. 4

DEVICE FOR PROTECTING AN UMBRELLA AGAINST INVERSION

CROSS REFERENCE TO RELATED APPLICATION

This application is a continuation-in-part of copending U.S. patent application Ser. No. 07/668,073, filed Mar. 12, 1991, now U.S. Pat. No. 5,131,422.

BACKGROUND OF INVENTION

This invention relates to umbrellas, and in particular to a device for protecting an umbrella against wind damage.

Umbrella design is typically driven by the requirement that the umbrella must be light in weight, and commonly used umbrella structures are relatively flexible. For this reason many umbrellas, particularly those of the collapsible kind, have a tendency to collapse from the inside out in response to excessive wind loads.

There have been a number of previous approaches to improving the resistance of an umbrella to inversion, as described in the following U.S. Patents:

| | |
|---|---|
| Desarno | 4,300,582 |
| Todorovic | 3,042,055 |
| Wendorf | 3,032,047 |
| Vila | 2,465,140 |
| Grissel | 2,114,598 |
| Illoway | 597,717 |
| Horton | 161,962 |
| Gossip | 122,453 |

These patents disclose various types of reinforcing cords, tapes or the like designed to resist the tendency of an umbrella to invert when subjected to a high wind load. In all of these patents other than the Desarno and Todorovic patents, the cord or tape is placed in the plane of the canopy. This arrangement provides disadvantages as described below. In the Desarno patent the cord is placed radially inward of the canopy. However, the cord is secured both to the canopy and to the ribs of the umbrella. This arrangement is not well-suited for a fixture that can be retrofitted easily to an existing umbrella, and it restricts movement of the canopy when the umbrella is folded.

The present invention is directed to an improved device for protecting an umbrella against inversion, which strengthens the umbrella against inversion without interfering with normal movement of the canopy, and which, in the preferred embodiments described below, can easily be retrofitted to an existing umbrella.

SUMMARY OF THE INVENTION

According to this invention, a plurality of couplers are provided, each secured to a respective one of the umbrella ribs to extend inwardly from the umbrella canopy toward the umbrella shaft. A tension member such as a cord is secured to the couplers to pass between the ribs and to form a closed loop having a length selected to brace the ribs against inversion. The tension member is disposed inwardly of the ribs, between the ribs and the shaft, when the umbrella is opened, and the canopy is free to move independently of the tension member between the couplers.

According to another aspect of this invention, an umbrella is provided with a tension member secured to the ribs to pass between the ribs to form a closed loop having a length selected to brace the ribs against inversion. The tension member is disposed at least in part inwardly of a line interconnecting adjacent ribs, between the ribs and the shaft, and the tension member is disposed at least in part inwardly of the canopy between the ribs when the umbrella is opened. The canopy is at least in part free to move independently of the tension member between the ribs.

BRIEF DESCRIPTION OF THE DRAWINGS

FIG. 1 is an elevational view in partial cutaway of an umbrella which incorporates a first preferred embodiment of this invention.

FIG. 2 is a bottom view taken along line 2—2 of FIG. 1.

FIG. 3 is an enlarged view of a portion of the embodiment of FIG. 1 within the illustrated circle.

FIG. 4 is a sectional view taken along line 4—4 of FIG. 3.

DETAILED DESCRIPTION OF THE PRESENTLY PREFERRED EMBODIMENTS

Figure 5:
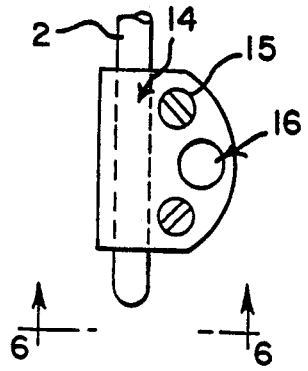
FIG. 5 is a plan view of a portion of a second preferred embodiment of this invention.
Figure 6:
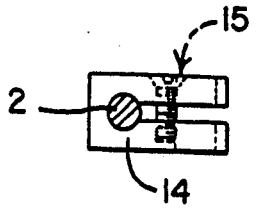
FIG. 6 is an end view taken along line 6-6 of FIG. 5.

Turning now to the drawings, FIGS. 1 and 2 show general views of an umbrella 1 having a central shaft 6 on which is slidably mounted an annular bushing 4. A plurality of ribs 2 are pivotably mounted to the central shaft 6 to move between the open position shown in FIGS. 1 and 2 and a closed position (not shown) in which the ribs 2 are positioned alongside the shaft 6. Intermediate ribs 3 extend between the ribs 2 and the bushing 4 and are used to hold the ribs 2 in the opened position of FIGS. 1 and 2. A canopy 7 is secured to the ribs 2 in the conventional manner, and a conventional handle 8 is mounted at one end of the shaft 6. The elements of the umbrella 1 described above are conventional in the art, and do not per se form part of this invention. Depending upon the application, the umbrella 1 can be of the collapsible type, in which the shaft 6 is designed to telescope, or it can alternately be of the fixed length type. A wide variety of designs can be used for the detailed structure of the ribs 2, 3, and a wide variety of materials can be used.

According to this invention, a tension member such as a cord 9 is secured by means of couplers 10 to the free ends of the ribs 2. As best shown in FIG. 2, the cord 9 forms a closed loop which is disposed radially inwardly from the ribs 2, between the ribs 2 and the shaft 6.

FIGS. 3 and 4 are enlarged fragmentary views that illustrate a first preferred arrangement for connecting the cord 9 to the ribs 2. As shown in these figures, each of the couplers 10 is a clip having an eye at one end through which the cord 9 passes and a hook at the other end. The rib 2 in this embodiment has an enlarged end 11 at the free end, and the canopy 7 is secured to the rib 2 by stitches 12. The hook portion of the coupler 10 is designed to fit around the rib 2 in the region between the enlarged end 11 and the stitches 12. The diameter of the opening in the hook end of the coupler 10 is smaller than both the enlarged end 11 and the portion of the rib 2 receiving the stitches 12. Thus, when the coupler 10 is installed as shown in FIG. 3, the coupler 10 is captured on the free end of the rib 2, and is positively prevented from sliding off the end of the rib, or sliding up the rib toward the shaft 6. In this embodiment, the coupler 10 is installed on the ribs 2 by separating the opposed portions of the hook end of the coupler 10 until the rib 2 can be inserted into the hook end. In this embodiment the coupler 10 is preferably formed of a spring steel which biases the coupler 10 into the position shown in FIG. 4, in which the rib 2 is positively captured in the hook.

The cord 9 is preferably light in weight, small in diameter, and substantially inextensible.

The coupler 10 can take various alternative forms, depending on the application. For example, as shown in FIG. 5, the cord may be releasably engaged on the rib 2 by means of a clamp 14 which defines an opening 16 sized to receive the cord. A pair of threaded fasteners 15 are used to lock the two sides of the clamp 14 together, thereby releasably securing the clamp 14 on the rib 2.

Figure 7:
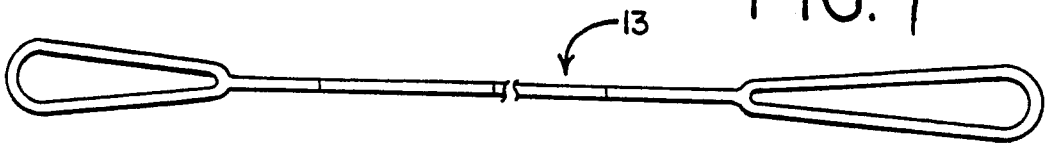
FIG. 7 is a plan view of a portion of a third preferred embodiment of this invention.

FIG. 7 shows a third preferred embodiment of a coupler 13 for securing the cord to the ribs. The coupler 13 is formed of a resilient material such as a suitable plastic or elastomer, and it defines two eyes, one at each end. The smaller eye may be passed through the larger eye to form a loop to receive the cord 9, and the smaller eye is sized to slip over the enlarged end of the rib to hold the coupler 13 in position on the rib.

The embodiments described above can either be incorporated into the umbrella at the time of manufacture, or they can be retrofitted to an existing umbrella. In either case, it may be desirable to provide a means for varying or adjusting the length of the cord 9. Two suitable approaches for accomplishing this function are shown in FIGS. 8-10.

Figure 8:
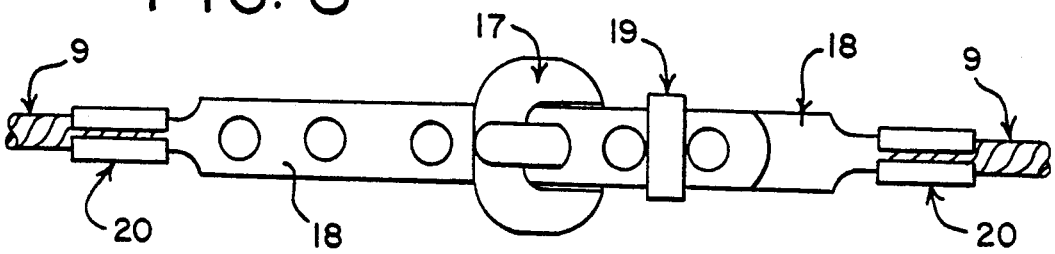
FIG. 8 is a plan view of a length adjusting mechanism suitable for use with the embodiment of FIG. 1.

In FIG. 8 each end of the cord 9 is coupled to a respective belt 18 by a connecting sleeve 20. One of the belts 18 supports a buckle 17 and a retaining loop 19. The other of the belts 18 defines a number of openings. The buckle 17 can be used to adjust the effective length of the cord 9.

Figure 9:
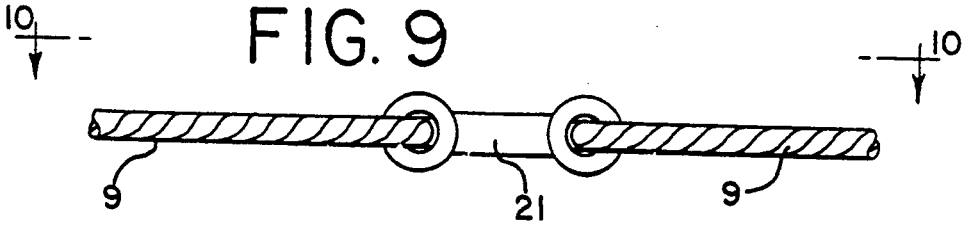
FIG. 9 is a plan view of an alternative length adjusting mechanism suitable for use with the embodiment of FIG. 1.
Figure 10:
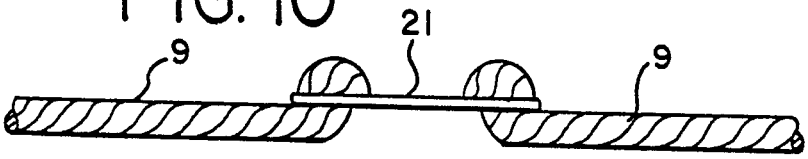
FIG. 10 is a view taken along line 10—10 of FIG. 9.

An alternate arrangement is shown in FIGS. 9 and 10, in which a plate 21 is provided with a pair of openings, each of which receives a respective free end of the cord 9. The ends of the cord 9 are provided with knots as shown in FIG. 10, which are larger in diameter than the diameters of the corresponding openings in the plate 21. By properly positioning the knots the effective length of the cord 9 can be adjusted. As yet another alternate, the two ends of the cord 9 may be simply knotted together to create the desired effective length for the closed loop.

Simply by way of example, braided rayon of the type supplied by Textile Craft Co. as part no. 5-5-3 has been found suitable for the cord 9, and a length of 3 to 3.5 inches has been found suitable for the coupler 10.

In operation, the cord 9 and the couplers 10 increase the stability of the umbrella 1, and its resistance to inversion. In high winds, pressure is applied to the underside of the canopy 7 in such a way as to tend to invert the canopy 7. If this wind pressure is uniformly distributed, it will tend to move the ribs outwardly. At some critical value of wind pressure, the ribs will invert. If wind pressure is not uniform, the ribs will move asymmetrically such that the ribs on one side of the umbrella deflect inwardly, and the ribs on the other side of the umbrella deflect outwardly. Such asymmetrical deflection may become so large that a few of the ribs may collapse and invert, thereby damaging the rest of the umbrella structure.

The cord 9 is preferably adjusted so as to provide a preload on the ribs 2 causing them to deflect somewhat inwardly of their rest position. During high winds when pressure is applied to the underside of the canopy 7, the preloaded ribs provide increased resistance to inversion. As shown in FIG. 2, the perimeter of the closed loop defined by the cord 9 (an octagon in this particular embodiment) is smaller than the perimeter of the edge of the canopy 7. For this reason, considerable stretching of the cord 9 would be required before the umbrella 1 could invert, and in this way the umbrella 1 is protected against inversion.

Figure 11:
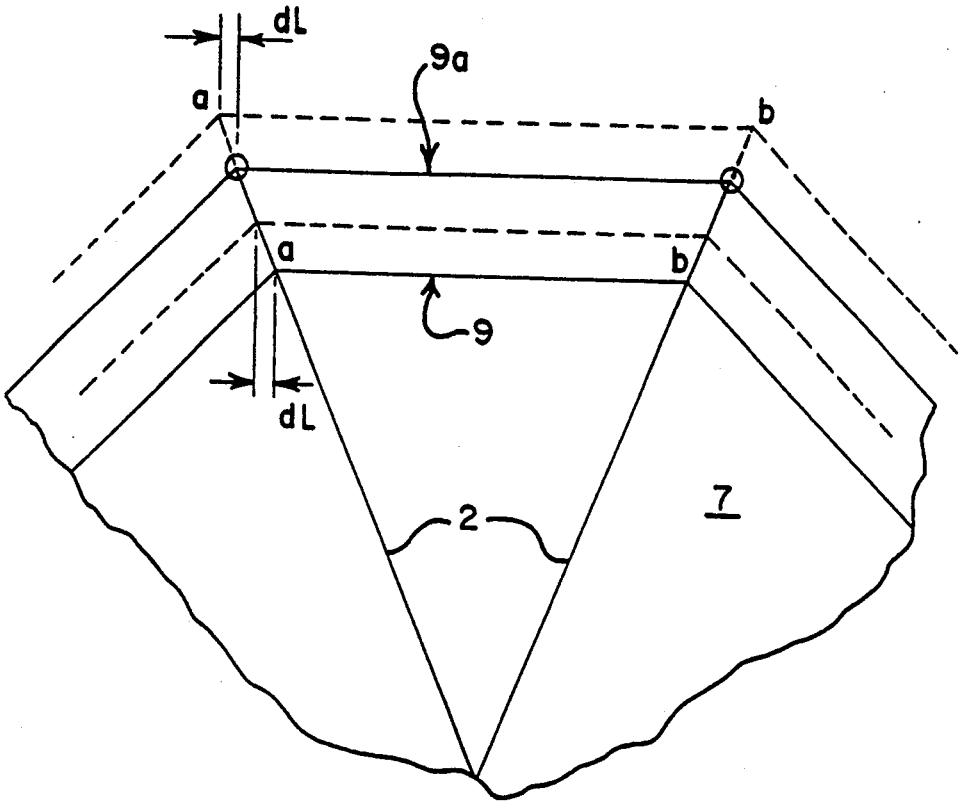
FIG. 11 is a schematic representation of a portion of the embodiment of FIG. 1 showing movement of the umbrella under symmetrical wind loading.

As shown in FIG. 11, the cord 9 is disposed radially inwardly of the tips of the ribs 2. For purposes of illustration, FIG. 11 shows an additional cord (cord 9*a*), which is positioned near the tips of ribs 2, and is therefore disposed radially outwardly of the cord 9. Of course, the cord 9*a* has a length greater than that of the cord 9, as is clear from FIG. 11.

If wind pressure on the inside of the canopy 7 is symmetrical, the ribs 2 will tend to move along the lines a—a and b—b. The deflected position of the cords 9, 9*a* is shown in dashed lines in FIG. 11. Both cords are moved by the same distance and, as shown in FIG. 11, this movement will cause each of the cords 9, 9*a* to elongate by the same amount dL. Assuming linear material properties, the stress in the cord S is equal to Ee, where E is the modulus of elasticity of the cord, and e is the strain. This equation can be rewritten in terms of load and cord length as follows:

$$N = AE(dL/L)$$

Where N is load along the cord, A is the crosssectional area of the cord, dL is the increase in the cord length due to elongation as described above, and L is the initial cord length. If both cords 9, 9*a* are made of the same material, then the product AE is equal to a constant C. The above equation can then be written for the cord 9*a* as follows:

$$N1 = C(dL/L1)$$

Similarly, the above equation can be rewritten for the cord 9 as follows:

$$N2 = C(dL/L2)$$

In this example, L1 is larger than L2, and N2 is therefore larger than N1. In other words, to stretch a shorter cord by the same amount as a longer cord requires a larger load to be applied to the shorter cord. This means that the shorter cord 9 as used in the embodiment described above will resist a larger load (i.e. a stronger wind) before the ribs 2 are deflected to the point where they can invert.

Figure 12:
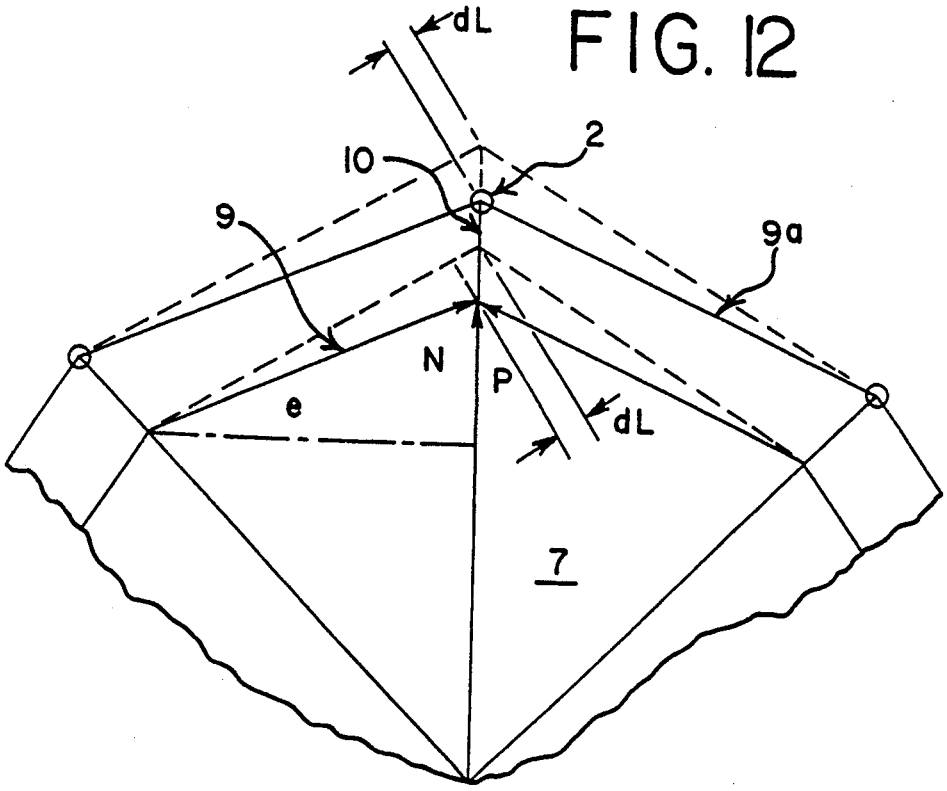
FIG. 12 is a schematic representation of a portion of the embodiment of FIG. 1 showing asymmetrical deformation of the umbrella under wind loading.

FIG. 12 illustrates movement of the cords 9, 9*a* in the event of asymmetrical wind loading. In this case, one or more of the ribs will experience a load which is larger by the amount P than the others. Due to this increased load, the rib will tend to move outwardly, causing equal elongation dL of the cords 9 and 9*a*. Due to the fact that the cord 9*a* is longer than the cord 9, a smaller load N is required to cause the elongation dL in the cord 9*a* than in the cord 9, in a manner similar to that described above in connection with FIG. 11.

The load N on the cord 9 is equal to P/sin(e) where e is an angle as shown in FIG. 12. A relatively smaller angle results in a larger load N. For an octagonal configuration (an umbrella with eight ribs) the angle e is equal to 22.5°, and N is larger than P by a factor of 2.6. This effect, combined with the fact that the length of the connector is much smaller than the length of the cord 9, indicates that elongation of the connector 10 is a negligible contribution to the total deflection of the structure.

When the wind pressure on the inside of the canopy 7 is not uniform, the resistance of the ribs 2 to inversion is increased by the opposite deflection of the opposing ribs. This means that when the rib 2 of FIG. 12 moves outwardly, all of the ribs of the umbrella will be deflected. This, even if the cord 9 is made of ideally rigid material, the rib 2 of FIG. 12 may deflect outwardly, causing deflection of the entire structure. This tendency can be resisted by adjusting the perimeter of the cord 9 to a smaller length. When this is done, a load directed oppositely to the load P will be applied to all of the ribs, causing them to be deflected radially inwardly. Uneven pressure applied to the underside of the canopy 9 as shown in FIG. 12 will be opposed by an increased resistance due to the fact that this motion will require further deflection of an already preloaded structure.

From the foregoing discussion, it should be apparent that important advantages are obtained by placing the cord radially inwardly of the ribs. Furthermore, these advantages are obtained without interfering with the free movement of the canopy 7 when the umbrella is folded. For example, the portions of the canopy 7 intermediate the ribs are free to fold outwardly when the umbrella is folded, and thus the cord 9 does not interfere with normal operation of the umbrella.

Figure 13:
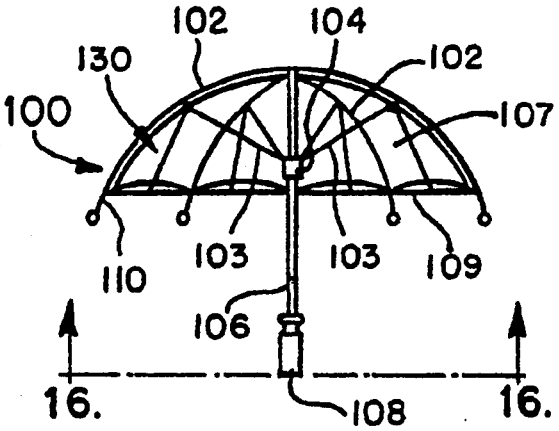
FIG. 13 is an elevational view in partial cutaway of an umbrella which incorporates a fourth preferred embodiment of this invention.

Turning now to FIGS. 13–17, alternative embodiments of the present invention can be provided in which the tension member and couplers are distributed differently than described above. FIG. 13 shows a general view of an umbrella having a central shaft 106 on which is slideably mounted an annular bushing 104. A plurality of ribs 102 are pivotably mounted to the central shaft 106 to move between the open position shown in FIG. 13 and a closed position (not shown) in which the ribs 102 are positioned along side the shaft 106. Intermediate ribs 103 extend between the ribs 102 and the bushing 104 and are used to hold the ribs 102 in the opened position of FIG. 13. A canopy 107 is secured to the ribs 102 in the conventional manner, and a conventional handle 108 is mounted at one end of the shaft 106.

The above described elements of the umbrella 100 can be identical to corresponding elements of the umbrella 1, and are conventional in the art. As pointed out above, the umbrella 100 can be of the collapsible type or it can alternately be of the fixed length type.

According to this invention, a tension member such as a cord 109 is secured by means of couplers 110 to the free ends of the ribs 102. As described above, the cord 109 forms a closed loop which is at least in part disposed radially inwardly from the ribs 102, between the ribs 102 and the shaft 106.

The umbrella 100 includes restraining members 130 which are flexible cords mounted between the ribs 102 and the cord 109. Preferably, the restraining members 130 are mounted to the cord 109 intermediate the couplers 110. The restraining members 130 are preferably formed of a stretchable material, and they provide the advantage of limiting the extent to which the cord 109 extends beyond the canopy 107 when the umbrella 100 is closed.

Figure 14:
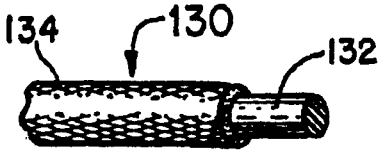
FIG. 14 is a fragmentary perspective view of a cord suitable for use as the tension member or the restraining member in the embodiment of FIG. 13.

As shown in FIG. 14, the restraining member 130 includes a central core 132 surrounded by a sheath 134. In this embodiment the core 132 is formed of a stretchable elastomeric material and the sheath 134 is formed of a substantially inextensible material. The sheath 134 can be formed of any suitable material including linen, silk, wool or synthetic materials. The material of the sheath 34 may if desired be braided around the cord 132.

Both the core 132 and the sheath 134 define a rest length, and the core 132 is more stretchable than the sheath 134. Preferably, the rest length of the core 132 is less than that of the sheath 134. This allows the sheath 134 to define the limiting length of the restraining member 130 (approximately equal to the rest length of the sheath 134). The core 132 shortens the restraining member 130 when it is not under tension, thereby further retracting the cord 109 within the canopy 107 when the umbrella is closed. If desired, the same material as that shown in FIG. 14 can be used for the cord 109 in order to reduce the length of the cord 109 when it is not under tension and thereby facilitate storage of the cord 109.

Figure 15:
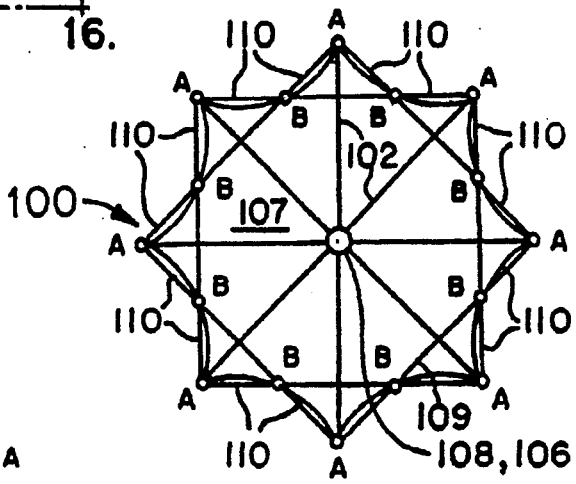
FIG. 15 is a bottom view taken along line 16—16 of FIG. 13 showing the arrangement of the tension member and the couplers.
Figure 16:
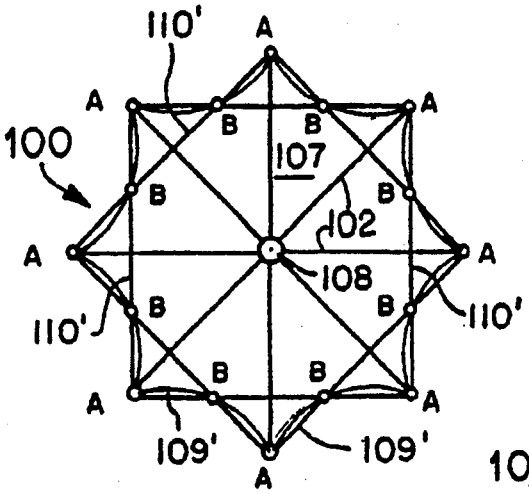
FIG. 16 is a view corresponding to FIG. 15 showing an alternate arrangement for the tension member and the couplers.
Figure 17:
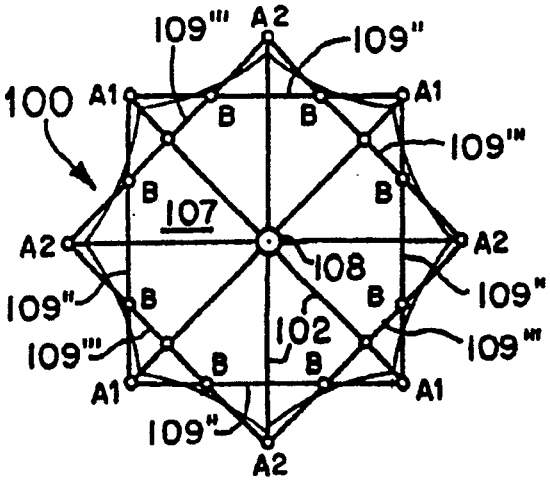
FIG. 17 is a view corresponding to FIG. 15 showing yet another arrangement for the tension member.

FIGS. 15, 16 and 17 are bottom views of the umbrella 100 which show three alternate arrangements for the cord 109 and the couplers 110. The restraining members 130 are not shown in FIGS. 15–17 for clarity. Nevertheless, the restraining members 130 can be included if desired in any of the embodiments of FIGS. 15–17.

In FIG. 15 the cord 109 defines a loop which is octagonal in shape and extends between the points labeled B. In this embodiment, there are two couplers 110 attached to each of the ribs 102 at point A. Each of the couplers 110 is secured at its inner end to the cord 109 at point B. The couplers 110 can take any desired form, and may for example be of the type described above in conjunction with FIGS. 1–12. Preferably, the couplers 110 are substantially inextensible, and they may be removably mounted to the tips of the ribs 102 if desired.

This embodiment is quite similar to that shown in FIG. 2 above, except that each rib is provided with a set of two couplers 110 and the couplers 110 are not oriented radially toward the central shaft 106. Of course, if desired the couplers 110 can each join the cord 109 at a separate point, providing a sixteen sided closed loop for the cord 109. This embodiment provides substantially the same advantages as those discussed above in conjunction with FIGS. 1-12.

FIG. 16 shows a second preferred arrangement for the tension member and the couplers of the umbrella 100. In this embodiment the couplers 110' extend between adjacent points B, and the cord 109' extends from the tip of each rib 102 to the ends of the adjacent coupler 110'. As shown in FIG. 16, the couplers 110' are arranged in an octagonal shape, and the cord 109' is arranged in the shape of a eight pointed star having outer apexes at points A defined by the ribs 102 and inner apexes at points B defined by the ends of the couplers 110'. Once again the cord 110' is disposed at least in part inwardly of a line interconnecting adjacent ribs. If desired, the couplers 110' can be made somewhat shorter than shown in FIG. 16 such that adjacent couplers 110' do not meet. This would cause the loop formed by the cord 109' to have more than sixteen sides.

FIG. 17 shows a third preferred embodiment which eliminates the need for the couplers 110. In this embodiment the tension member is formed as two separate cords 109'' and 109'''. The cord 109'' extends between the free ends of alternating ribs 102 to form a square bounded by points A1. Similarly, the cord 109''' also forms a square, in this case extending between points A2. Thus, each of the cords 109'', 109''' extends only between alternate ribs. In general, where there are N ribs, the first cord will extend from rib 1 to rib 1+M, to rib 1+2M . . . for M greater than 1 and less than N/M. The second cord will extend from rib 2 to rib 2+M, to rib 2+2M . . . . If desired additional cords can be provided if the umbrella has a sufficient number ribs. Once again, it should be noted that at least in part the cords 109'', 109''' extend inwardly of a line interconnecting adjacent ribs. If desired, the cords 109'', 109''' can be interconnected with one another at the points B to facilitate storage when the umbrella 100 is closed.

In all of these embodiments, the canopy 107 is not connected to the cords 109, 109', 109'', 109''', and thus the cords do not interfere with free movement of the canopy. Inversion protection is nevertheless provided as described above.

Of course, a range of changes and modifications can be made to the preferred embodiments described above. For example, the coupler 10 may take various other forms, including link or bead chains having hooks and eyes on both ends. A variety of materials can be used such as steel, bronze, aluminum or a suitable plastic material, and, of course, various decorative coatings can be used as desired. The cord 9 may be made of various materials such as silk, nylon or even wire rope.

Additionally, it is not always required to provide means for adjusting the length of cord 9. For example, the ends of the cord 9 can be secured together by permanently installed sleeves similar to the sleeves 20 in FIG. 8. In this case, the length of the cord should be selected in such a way as to ensure proper preloading of the ribs 2. The couplers 10 may be designed for permanent installation on the ribs 2, or they may be designed to be detachable from the ribs 2.

It is therefore intended that the foregoing detailed description be regarded as illustrative rather than limiting, and that it be understood that it is the following claims, including all equivalents, which are intended to define the scope of this invention.

I CLAIM:

1. In an umbrella of the type having a shaft, an array of ribs pivotably mounted to the shaft, and a flexible canopy mounted to the ribs, the improvement comprising:

a tension member secured to the ribs to pass between the ribs to form a closed loop having a length selected to brace the ribs against inversion;

said tension member disposed at least in part inwardly of line interconnecting adjacent ribs, between the ribs and the shaft, and said tension member disposed at least in part inwardly of the canopy between the ribs when the umbrella is opened; and said canopy being at least in part free to move independently of the tension member between the ribs.

2. The invention of claim 1 wherein the tension member comprises a first, more stretchable component and a second, substantially less stretchable component, said first component having a rest length less than that of the second component such that said tension member is readily stretchable up to a limiting length defined by the second component, thereby facilitating storage of the tension member when the umbrella is closed.

3. The invention of claim 2 wherein the second component envelopes the first component.

4. The invention of claim 1 further comprising:

a plurality of restraining members, each secured between the umbrella and the tension member to reduce extension of the tension member beyond the canopy when the umbrella is closed.

5. The invention of claim 4 wherein the restraining members are resiliently stretchable.

6. The invention of claim 4 wherein the restraining members comprise a first, more stretchable component and a second, less stretchable component, said first component having a rest length less than that of the second component.

7. The invention of claim 4 wherein at least some of the restraining members are secured between the umbrella and the tension member intermediate the ribs.

8. The invention of claim 1 further comprising:

a plurality of couplers, each secured to the tension member at two points on opposite sides of a respective rib such that the couplers position the tension member toward the shaft between the ribs when the umbrella is opened.

9. The invention of claim 1 wherein the array of ribs comprises N ribs, wherein the tension member is mounted to extend between ribs 1, 1+M, 1+2M, . . . , where M is an integer greater than 1 and less than N/M, and wherein the umbrella further comprises a second tension member, said second tension member mounted to extend between ribs 2, 2+M, 2+2M, . . . ; and wherein said first mentioned and second tension members are mounted to separate ones of the ribs, each tension member forming a closed loop having a length selected to brace the ribs against inversion.

10. The invention of claim 1 further comprising:

a plurality of sets of couplers, each set secured to the tension member and to a respective one of the ribs such that the couplers extend inwardly from the ribs toward the shaft, each of the sets of couplers comprising at least two couplers.

* * * * *

UNITED STATES PATENT AND TRADEMARK OFFICE

CERTIFICATE OF CORRECTION

PATENT NO. : 5,277,212
DATED : January 11, 1994
INVENTOR(S) : Victor Aronov

It is certified that error appears in the above-indentified patent and that said Letters Patent is hereby corrected as shown below:

Title page item [56] , line 5, delete "539,752" and substitute --539,762-- therefor.

In column 5, line 39, delete "This" and substitute --Thus--.

In column 5, line 63, after "umbrella" insert --100--.

Signed and Sealed this
Sixth Day of September, 1994

*Attest:*

*Attesting Officer*

Bruce Lehman

BRUCE LEHMAN

*Commissioner of Patents and Trademarks*